US010456884B2

(12) United States Patent
McPhee et al.

(10) Patent No.: US 10,456,884 B2
(45) Date of Patent: Oct. 29, 2019

(54) LINER SYSTEM FOR A MILL SHELL

(71) Applicant: Polycorp Ltd., Elrora (CA)

(72) Inventors: Robert Michael McPhee, Burlington (CA); Pramod Kumar, Waterloo (CA); Stanley Emerson Lennox, Guelph (CA)

(73) Assignee: Polycorp Ltd., Elora, Ontario (CA)

( * ) Notice: Subject to any disclaimer, the term of this patent is extended or adjusted under 35 U.S.C. 154(b) by 267 days.

(21) Appl. No.: 15/599,599

(22) Filed: May 19, 2017

(65) Prior Publication Data

US 2017/0334031 A1 Nov. 23, 2017

Related U.S. Application Data

(60) Provisional application No. 62/338,832, filed on May 19, 2016.

(51) Int. Cl.

| | |
|---|---|
| ***B24B 5/01*** | (2006.01) |
| ***B24B 3/02*** | (2006.01) |
| *B02C 17/22* | (2006.01) |

(52) U.S. Cl.

CPC ..... *B24B 5/01* (2013.01); *B24B 3/022* (2013.01); *B02C 17/22* (2013.01)

(58) Field of Classification Search

CPC ..... B24B 5/01; B24B 3/022; B02C 17/22
USPC ..... 451/119
See application file for complete search history.

(56) References Cited

U.S. PATENT DOCUMENTS

| | | | |
|---|---|---|---|
| 2,058,257 | A | 4/1935 | Porteous |
| 2,274,331 | A | 2/1942 | Howes |
| 2,362,811 | A | 11/1944 | Fitzgerald |
| 3,211,387 | A | 10/1965 | Russell et al. |
| 3,231,203 | A | 1/1966 | Hardinge et al. |
| 3,378,209 | A | 4/1968 | Crocheron |
| 3,804,346 | A | 4/1974 | Norman |
| 4,141,511 | A | 2/1979 | Anderson |

(Continued)

FOREIGN PATENT DOCUMENTS

| | | |
|---|---|---|
| CA | 1301731 | 5/1992 |
| CN | 200995157 Y | 12/2007 |

(Continued)

OTHER PUBLICATIONS

English Translation of CN200995157Y.

(Continued)

*Primary Examiner* — George B Nguyen

(57) ABSTRACT

A liner system for installation in a rotatable mill shell having an inner side and an opposed outer side, the liner system including one or more lifter bars. The lifter bar includes a body, a channel plate secured to the body and defining a channel axis, including one or more lateral extensions extending transversely from the central portion in relation to the channel axis, and one or more insert elements positioned between the lateral extension and the inner side of the mill shell, for resisting outward movement of the lateral extension toward the inner side. The liner system also includes one or more attachment assemblies, each including a bolt, for securing the lifter bar to the mill shell. The insert elements are configured to maintain the bolt in a predetermined position in which an axis of the bolt is aligned with the channel axis.

17 Claims, 17 Drawing Sheets

(56) References Cited

U.S. PATENT DOCUMENTS

| | | | | |
|---|---|---|---|---|
| 4,177,955 | A | 12/1979 | Miller | |
| 4,230,326 | A * | 10/1980 | White | B02C 17/22 16/2.2 |
| 4,231,528 | A | 11/1980 | Schaeffer | |
| 4,243,182 | A | 1/1981 | Dugger, Jr. | |
| 4,270,705 | A | 6/1981 | Larsen | |
| 4,289,279 | A | 9/1981 | Brandt | |
| 4,312,749 | A | 1/1982 | Bingham | |
| 4,319,719 | A | 3/1982 | Larsen | |
| 4,341,355 | A | 7/1982 | Hornberger | |
| 4,402,465 | A | 9/1983 | Persson et al. | |
| 4,406,417 | A | 9/1983 | Jardine et al. | |
| 4,424,938 | A | 1/1984 | Day | |
| 4,441,659 | A | 4/1984 | Marklund | |
| 4,609,158 | A | 9/1986 | Wilson | |
| 4,848,681 | A | 7/1989 | Eriksson et al. | |
| 5,019,196 | A | 5/1991 | McKibben et al. | |
| 5,104,049 | A | 4/1992 | McKibben et al. | |
| 5,361,997 | A | 11/1994 | Burkes | |
| 5,431,351 | A | 7/1995 | Lejonklou | |
| 5,516,051 | A | 5/1996 | Brisbois et al. | |
| 5,752,665 | A | 5/1998 | Wason | |
| 5,814,273 | A | 9/1998 | Nielsen | |
| 6,036,127 | A | 3/2000 | Moller | |
| 6,206,310 | B1 | 3/2001 | Schneider | |
| 6,622,951 | B1 | 9/2003 | Recker et al. | |
| 7,204,636 | B2 | 4/2007 | Didion | |
| 7,861,960 | B2 | 1/2011 | Bhide | |
| 7,887,000 | B2 | 2/2011 | Siitonen et al. | |
| 8,152,086 | B2 | 4/2012 | Moller et al. | |
| 8,622,330 | B2 | 1/2014 | Mepham et al. | |
| 10,112,200 | B2 * | 10/2018 | Grozdanich | B02C 17/163 |
| 2002/0134871 | A1 | 9/2002 | Anderson | |
| 2003/0141396 | A1 | 7/2003 | Whaley | |
| 2007/0284464 | A1 | 12/2007 | Nordell | |
| 2009/0065618 | A1 | 3/2009 | Abarca Melo et al. | |
| 2009/0166456 | A1 | 7/2009 | Hellman et al. | |
| 2010/0127109 | A1 | 5/2010 | Moller et al. | |
| 2011/0073694 | A1 * | 3/2011 | Timm | B02C 17/225 241/182 |

FOREIGN PATENT DOCUMENTS

| | | | | |
|---|---|---|---|---|
| FR | 2615409 | | 11/1988 | |
| GB | 2129706 | | 5/1984 | |
| WO | 2011037600 | A1 | 3/2011 | |
| WO | WO-2012012880 | A1 * | 2/2012 | B02C 17/22 |

OTHER PUBLICATIONS

International Search Report prepared by the Canadian Intellectual Property Office for International Application No. PCT/CA2010/001836, dated Mar. 9, 2011.

Written Opinion prepared by the Canadian Intellectual Property Office for International Application No. PCT/CA2010/001836, dated Mar. 9, 2011.

International Search Report prepared by the Canadian Intellectual Property Office for International Application No. PCT/CA2011/000554, dated Aug. 16, 2011.

Written Opinion prepared by the Canadian Intellectual Property Office for International Application No. PCT/CA2011/000554, dated Aug. 16, 2011.

* cited by examiner

LINER SYSTEM FOR A MILL SHELL

CROSS-REFERENCE TO RELATED APPLICATION

This application claims the benefit of U.S. Provisional Patent Application No. 62/338,832, filed on May 19, 2016, the entirety of which is hereby incorporated by reference.

FIELD OF THE INVENTION

The present invention is a liner system for installation in a rotatable mill shell.

BACKGROUND OF THE INVENTION

As can be seen in FIG. 1, the prior art lifter bar 20 is typically attached to a rotatable mill shell 22 of a grinding mill by an attachment assembly 24. The lifter bar 20 is part of a lining 26 of the grinding mill, which typically includes a number of the lifter bars 20 and a number of shell plates. As shown in FIG. 1, the lifter bar 20 typically is positioned between two of the shell plates, identified in FIG. 1 by reference numerals 28A, 28B for convenience.

The lifter bars and shell plates may be made of various materials, and may include combinations of materials. For example, the lifter bars may be primarily made of a suitable rubber, a suitable composite, or a suitable steel. The prior art lifter bars may include various inserts or other parts made of different materials.

Typically, the lifter bar 20 includes a body 29 and a channel plate 30 (made of steel or aluminum, or any other suitable material) that extends along the length of the lifter bar 20. The channel plate 30 also defines a channel 32 in the lifter bar 20 in which part of the attachment assembly 24 is receivable.

The mill shell 22 includes a hole or slot 34 in which a bolt 36 is partially receivable. As can be seen in FIG. 1, the bolt 36 includes a head 38 at an inner end 39 of the bolt 36 that is engageable with an inner washer 40 that holds the head 38 in the channel 32. The bolt 36 extends between its inner end 39 and an outer end 42 thereof. As can also be seen in FIG. 1, the attachment assembly 24 typically also includes a nut 44 threadably engageable with the bolt 36 at the outer end 42. The nut 44, when tightened, urges an outer washer 46 against the mill shell 22, to subject the bolt 36 to tension, thereby pulling the lifter bar 20 outwardly (i.e., in the direction indicated by arrow "A" in FIG. 1), to secure the lifter bar in place inside the mill shell. (As will be described, the remainder of the drawings illustrate the present invention.)

The shell plates 28A, 28B include respective lip portions, identified by reference numerals 48A and 48B respectively in FIG. 1 for clarity of illustration. As can be seen in FIG. 1, the lip portions 48A, 48B are squeezed between the lifter bar 20 and the mill shell 22 when the nut 44 is tightened on the bolt 36.

In the arrangement illustrated in FIG. 1, the lifter bar body 29 is primarily made of rubber, and the shell plates 28A, 28B (including the lip portions 48A, 48B) are also made of rubber. The channel plate 30 preferably includes generally lateral extensions 50A, 50B that are pressed against portions 52A, 52B of the body 29 of the lifter bar 20 that are positioned between the lateral extensions 50A, 50B and the respective lip portions 48A, 48B. Where the body 29 is a suitable rubber or rubber composite, the channel plate 30 is initially held in place by vulcanization, i.e., by a chemical bond. However, once the attachment assembly 24 is tightened to secure the lifter bar 20 in place inside the mill shell 22, the lateral extensions 50A, 50B are also mechanically secured to the portions 52A, 52B of the body 29.

A charge (not shown) is positioned in the grinding mill, and the mill shell 22 is rotated, for comminution of pieces of ore in the charge that tumble against each other, and against the lining 26. As is well known in the art, the charge may include water and grinding media (e.g., balls, or rods). It will be understood that references herein to "solid parts of the charge" that collide with the lifter bar body include the pieces of ore, and where the charge includes grinding media, the solid parts of the charge may also include pieces of the grinding media.

As is known in the art, the body 29 that is at least partially rubber is at least somewhat resilient. The limited resilience of the at least partially rubber body 29 is thought to advantageously decrease the rate of wear of the body, because the resilience allows the lifter bar body 29 to absorb some of the dynamic impact of the solid parts of the charge colliding with it. However, as will be described, it appears that the resilience of the body 29 may result in premature failure of the bolt.

When in use, the mill shell 22 is rotated in the direction indicated by arrow "B". As a result, the solid parts of the charge inside the mill shell 22, tumbling as the mill shell 22 is rotated in the direction indicated by arrow "B", generally exert compressive force against the lifter bar 20 in the direction generally indicated by arrow "C", i.e., due to dynamic loading of the solid parts of the charge on the lifter bar 20. It will be understood that the impacts of the tumbling solid parts of the charge on the lifter bar are multi-directional. Only one arrow ("C") is used to represent the directions of the compressive forces dynamically exerted on the lifter bar by the tumbling solid parts of the charge, to simplify the illustration.

As illustrated in FIG. 1, at least some of the solid parts of the charge dynamically load the body in a direction that is at least partially transverse, e.g., such as schematically represented by arrow "C" in FIG. 1, and these may cause small pivoting movements of the lateral extensions. Also, the solid parts of the charge colliding with the body in other directions (e.g., in the direction indicated by arrow "A") may cause small outward pivoting movements of the lateral extensions 50A, 50B. Over time, a relatively large number of collisions of the solid parts of the charge with the lifter bar occur.

The prior art has many disadvantages. In particular, in the prior art attachment assembly 24, the bolt 36 tends to break relatively frequently. The bolt 36 typically fractures in the region identified as "X" in FIG. 1. At this point, the mechanism of the failure of the bolt 36 is not well understood.

It is believed that the fracturing or rupturing of the bolt is the result of small rotational or pivoting movements of the lifter bar and the inner washer generally as indicated by arrow "D" in FIG. 1. In particular, it is thought that the solid parts of the charge that dynamically collide with the lifter bar (for example, as schematically represented by arrow "C") urge the channel plate to pivot about a point on the bolt identified as "Y" in FIG. 1 (or a number of points), as schematically represented by arrow "D" in FIG. 1. Such rotational or pivoting movements, although initially small, are thought to gradually increase (due to repeated collisions of the solid parts of the charge with the body 29) until they are sufficient to subject the bolt to bending, and/or twisting (i.e., torque). It is believed that repeated bending (and/or twisting) of the bolt eventually results in metal fatigue, ultimately causing the bolt 36 to fail.

As is known in the art, the body 29 of the lifter bar 20 is primarily made of rubber formulated to have only limited resilience, so as to maximize its useful life. However, such rubber does have resilience, to a limited extent. As is well known in the art, the resilience of the rubber body 29 is believed to lessen the impact of the solid parts of the charge striking the body 29, thereby reducing wear and providing for a relatively longer useful life. The initial rotational movement of the channel plate 30 in response to the solid parts of the charge striking the lifter bar 20 is believed to be possible because the portions 52A, 52B of the body 29 of the lifter bar 20 are resilient, albeit to a limited extent only.

Similarly, the lip portions 48A, 48B typically are primarily made of the same or a similar rubber material as the lifter bar 20. The rotational movements are also thought to be permitted by the limited resilience of the lip portions 48A, 48B.

In general, due to the very high costs (i.e., because of lost production) associated with downtime of the grinding mill, it is critical that downtime be minimized. However, when the attachment assembly 24 no longer secures the lifter bar in position inside the mill shell (e.g., due to the bolt's failure), the grinding mill is taken off-line until repairs can be completed.

SUMMARY OF THE INVENTION

For the foregoing reasons, there is a need for a system that overcomes or mitigates one or more of the disadvantages or defects of the prior art. Such disadvantages or defects are not necessarily included in those described above.

In its broad aspect, the invention provides a liner system for installation in a rotatable mill shell having an inner side and an opposed outer side. The liner system includes one or more lifter bars, each lifter bar including a body thereof and a channel plate secured to the body and defining a channel axis. The channel plate includes a central portion aligned with the channel axis and one or more lateral extensions extending transversely from the central portion in relation to the channel axis. The channel plate additionally includes one or more outer arms and a cavity that is at least partially defined by the outer arm(s). The lifter bar also includes one or more insert elements positioned between the lateral extension(s) and the inner side of the mill shell, for resisting outward movement of the lateral extension(s) toward the inner side. The liner system also includes one or more attachment assemblies including a fixing washer at least partially positioned in the cavity and engaged with the outer arm. The outer arm is formed to resist movement of the fixing washer outwardly, toward the inner side of the mill shell. The attachment assembly also includes a bolt defining a bolt axis and extending between inner and outer ends, the bolt comprising a head at the inner end engageable with the fixing washer. The bolt is positionable in a predetermined position relative to the mill shell in which the bolt axis is substantially aligned with the channel axis, with the inner end engaged with the fixing washer and the outer end positioned outside the mill shell. In addition, the attachment assembly also includes a nut threadably engageable with the bolt at the bolt's outer end, and an outer washer between the nut and the outer side of the mill shell, and engageable with the outer side of the mill shell when the nut is tightened to subject the bolt to tension, to urge the head outwardly toward the inner side of the mill shell, securing the lifter bar inside the mill shell. The insert elements are configured to maintain the bolt in the predetermined position.

In another of its aspects, the invention provides a lifter bar to be secured in a rotatable mill shell having an inner side and an opposed outer side. The lifter bar includes a body thereof and a channel plate secured to the body and defining a channel axis. The channel plate includes a central portion aligned with the channel axis and one or more lateral extensions extending transversely from the central portion in relation to the channel axis. The channel plate additionally includes one or more outer arms and a cavity that is at least partially defined by the outer arm. The lifter bar also includes one or more insert elements positioned between the lateral extension(s) and the inner side of the mill shell, for resisting outward movement of the lateral extension(s) toward the inner side.

In another aspect, the invention provides a lifter bar to be secured in a rotatable mill shell having an inner side and an opposed outer side. The lifter bar includes a body and a channel inner plate secured to the body and partially defining a channel axis, the channel inner plate including a central portion thereof and a pair of lateral extensions, each lateral extension extending from the central portion a predetermined distance from the channel axis respectively. The lifter bar also includes a pair of channel outer plates secured to the body and positioned between the channel inner plate and the inner side of the mill shell, each channel outer plate including respective outer portions positioned to engage selected ones of the transverse portions respectively, to resist movement of the respective transverse portions outwardly toward the inner side of the mill shell. The lifter bar also includes a channel central housing at least partially positioned between the channel inner plate and the channel outer plates for resisting outward movement of the channel inner plate toward the inner side of the mill shell, the channel central housing including one or more outer arms and a cavity therein that is at least partially defined by the outer arm.

In yet another of its aspects, the invention provides a lifter bar to be secured in a rotatable mill shell having an inner side and an opposed outer side. The lifter bar includes a body and a channel inner plate secured to the body and partially defining a channel axis. The channel inner plate includes a central portion thereof and a pair of lateral extensions, each lateral extension extending from the central portion a predetermined distance from the channel axis respectively. The lifter bar also includes a pair of channel outer plates secured to the body and positioned between the channel inner plate and the inner side of the mill shell, each channel outer plate including respective outer portions positioned to engage the respective transverse portions, to resist movement of the respective transverse portions outwardly toward the inner side of the mill shell. In addition, the lifter bar includes a channel central housing at least partially positioned between the channel inner plate and the channel outer plates, for locating the channel inner plate, the channel central housing including one or more outer arms and a cavity therein that is at least partially defined by the outer arm. The lifter bar also includes a pair of insert elements respectively positioned between the outer portions of the channel outer plates and the inner surface of the mill shell to resist movement of the respective transverse portions outwardly, the inserts being secured to the body of the lifter bar.

In another of its aspects, the invention provides a method of maintaining a bolt securing a lifter bar in a rotatable mill shell having an inner side and an opposed outer side in a predetermined position. The method includes providing a channel plate secured to a body of the lifter bar, the channel plate having a central portion defining a channel axis and one or more lateral extensions extending transversely from the central portion in relation to the channel axis. Insert elements are located between the lateral extensions and the inner side of the mill shell, and secured to the lateral extensions, for resisting movement of the lateral extensions toward the inner side of the mill shell.

BRIEF DESCRIPTION OF THE DRAWINGS

The invention will be better understood with reference to the drawings, in which.

DETAILED DESCRIPTION

Figure 1:
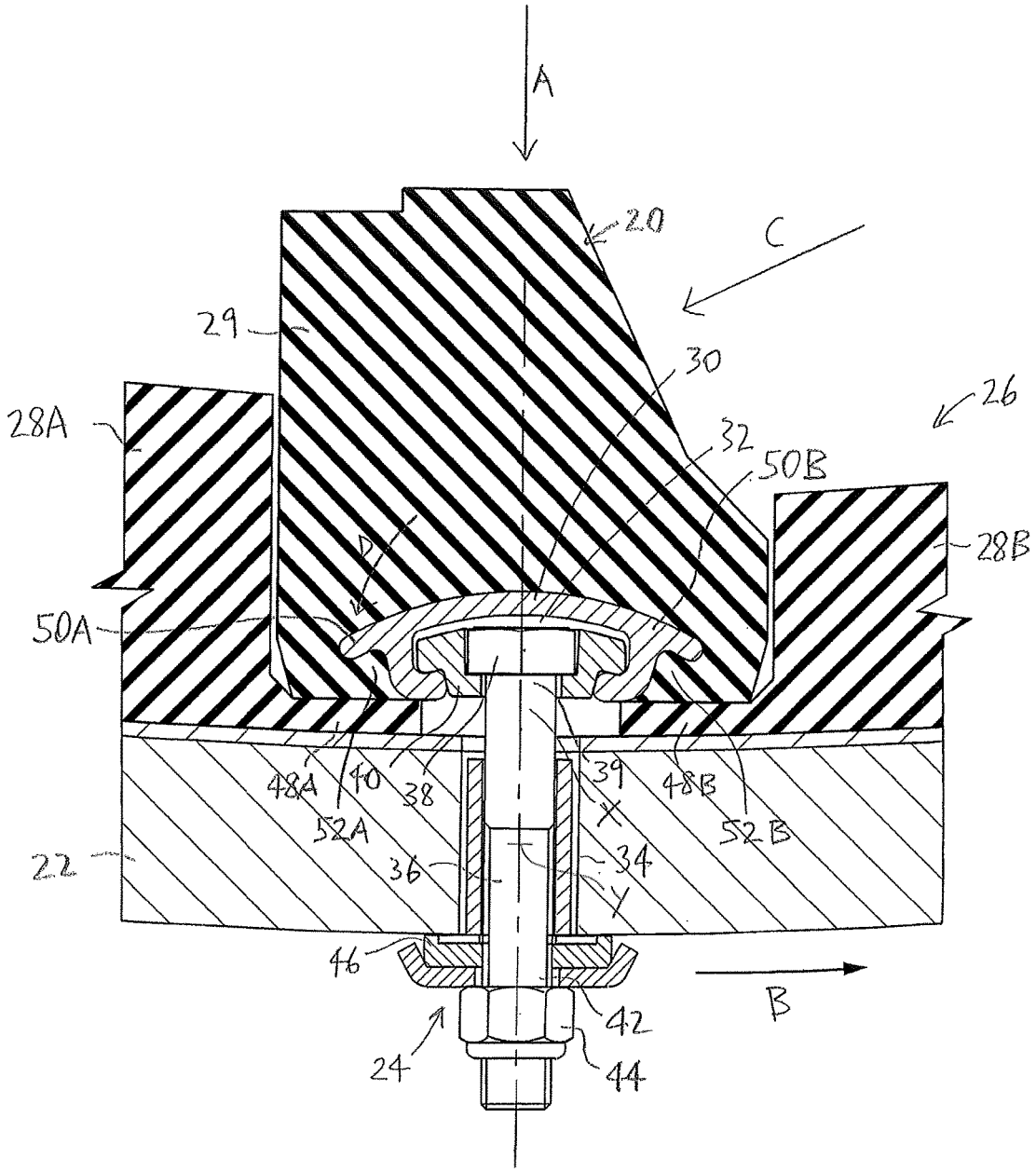
FIG. 1 (PRIOR ART)
FIG. 1 (previously described) is a partial cross-section of a lifter bar and an attachment assembly of the prior art.
Figure 2A:
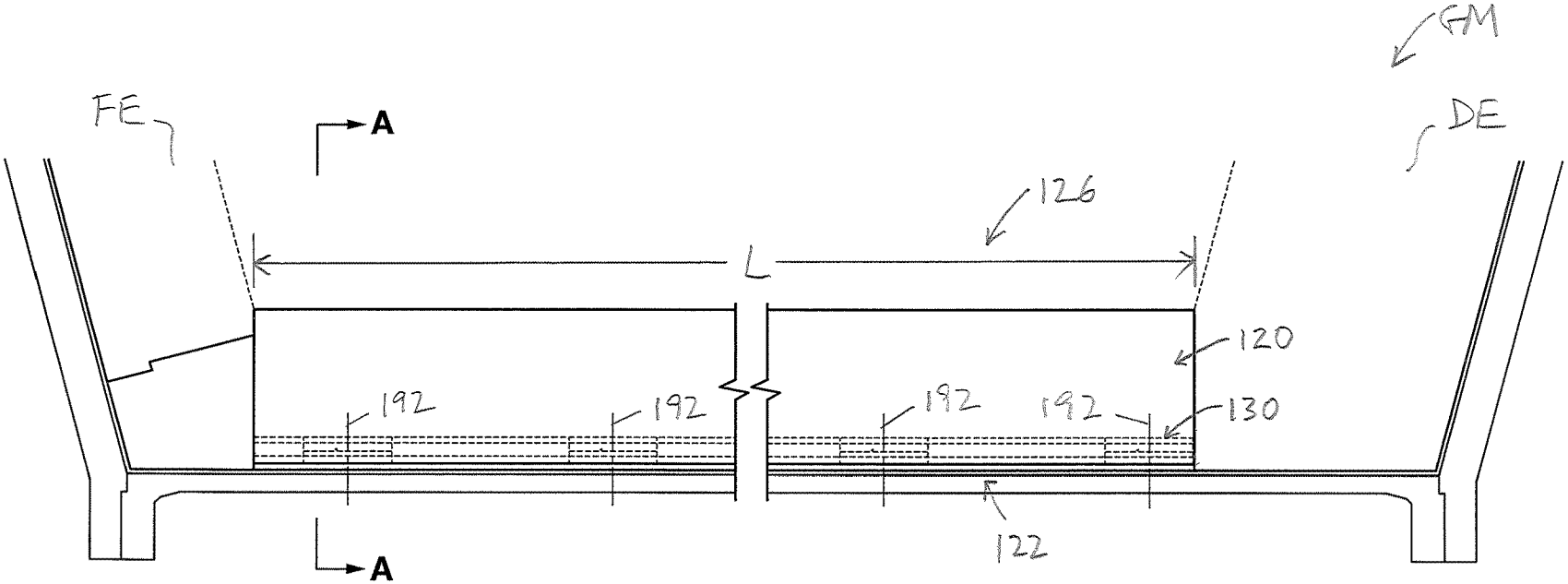
FIG. 2A is a longitudinal section of a grinding mill in which an embodiment of a liner system of the invention is secured to a mill shell, drawn at a smaller scale.
Figure 2B:
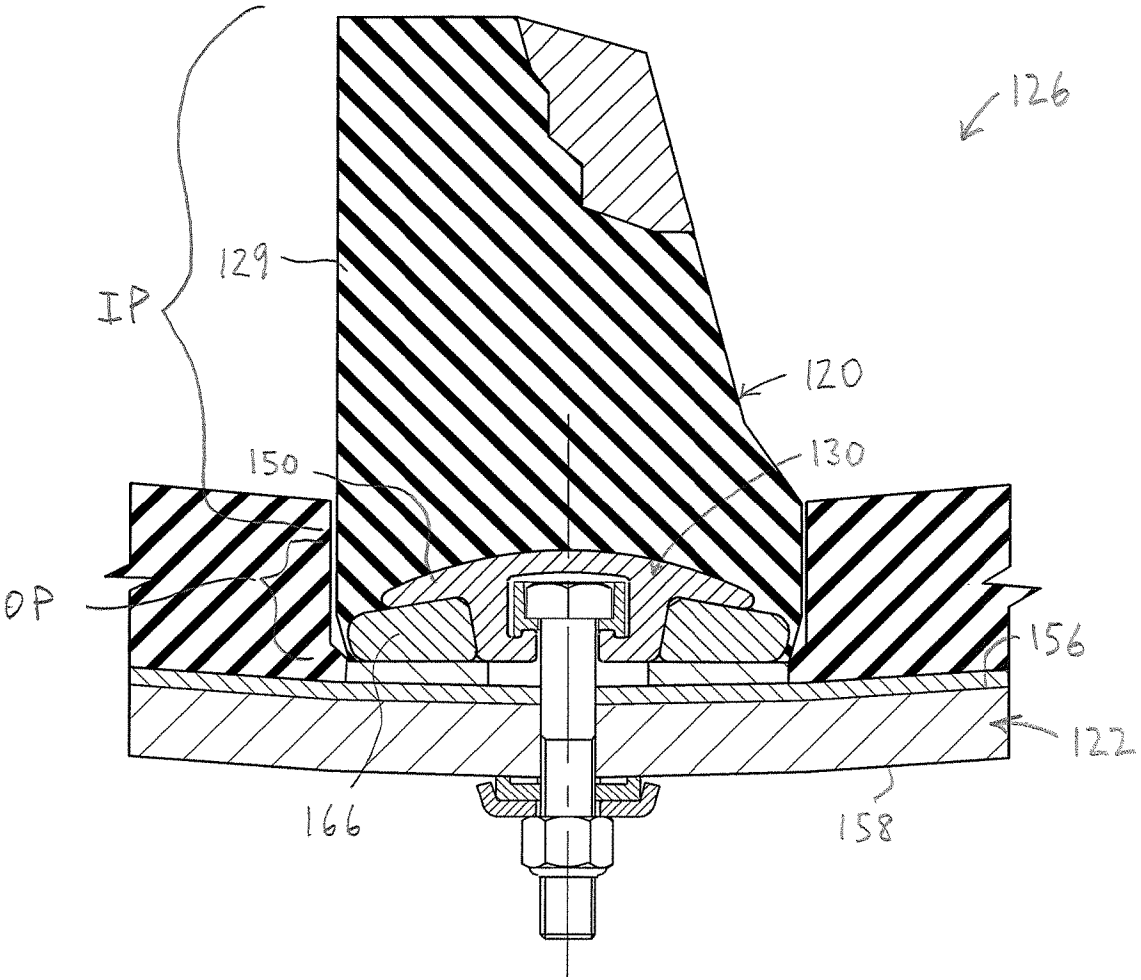
FIG. 2B is a cross-section of an embodiment of a lifter bar of the invention included in the liner system of FIG. 2A and an attachment assembly securing the lifter bar to the mill shell taken along line A-A in FIG. 2A, drawn at a larger scale.

In the attached drawings, like reference numerals designate corresponding elements throughout. Reference is first made to FIGS. 2A, 2B, and 2D-4B to describe an embodiment of a liner system in accordance with the invention indicated generally by the numeral 126. The liner system 126 is for installation in a rotatable mill shell 122 having an inner side 156 and an opposed outer side 158 (FIGS. 2B, 2E). In one embodiment, the liner system 126 preferably includes one or more lifter bars 120. Preferably, the lifter bar 120 includes a body 129 thereof and a channel plate 130 secured to the body 129 that defines a channel axis 160 (FIG. 2F). It is preferred that the channel plate 130 includes a central portion 162 (FIG. 2F) aligned with the channel axis 160 and one or more lateral extensions 150 (FIG. 2B) extending transversely from the central portion 162 in relation to the channel axis 160. Preferably, the channel plate 130 additionally includes one or more outer arms 163 and a cavity 164 that is at least partially defined by the outer arm 163 (FIG. 2F). As can be seen in FIGS. 2B, 2E, and 2F, it is also preferred that the lifter bar 120 includes one or more insert elements 166 (FIG. 2B) positioned between the lateral extension 150 and the inner side 156 of the mill shell 122, for resisting outward movement of the lateral extension 150 toward the inner side 156. Preferably, the liner system 126 also includes one or more attachment assemblies 124 (FIG. 2F). As can be seen in FIG. 2F, the attachment assembly 124 preferably includes a fixing washer 168 at least partially positioned in the cavity 164 and engaged with the outer arm 163, the outer arm 164 being formed to resist movement of the fixing washer 168 outwardly, toward the inner side 156 of the mill shell 122. As also illustrated in FIG. 2F, the attachment assembly 124 preferably includes a bolt 136 defining a bolt axis 170 and extending between inner and outer ends 139, 142, the bolt 136 having a head 138 at the inner end 139 engageable with the fixing washer 168. Preferably, and as shown in FIG. 2F, the bolt 136 is positionable in a predetermined position relative to the mill shell 122 in which the bolt axis 170 is substantially aligned with the channel axis 160, with the inner end 139 engaged with the fixing washer 168 and the outer end 142 positioned outside the mill shell 122. The attachment assembly 124 preferably also includes a nut 144 threadably engageable with the bolt 136 at the bolt's outer end 142, and an outer washer 146 positioned between the nut 144 and the outer side 158 of the mill shell 122. The outer washer 146 engages the outer side 158 of the mill shell 122 when the nut 144 is tightened to subject the bolt 136 to tension, to urge the head 138 outwardly toward the inner side 156 of the mill shell 122, securing the lifter bar 120 inside the mill shell 122. As will also be described, the insert element 166 preferably is configured to maintain the bolt 136 in the predetermined position.

Figure 3:
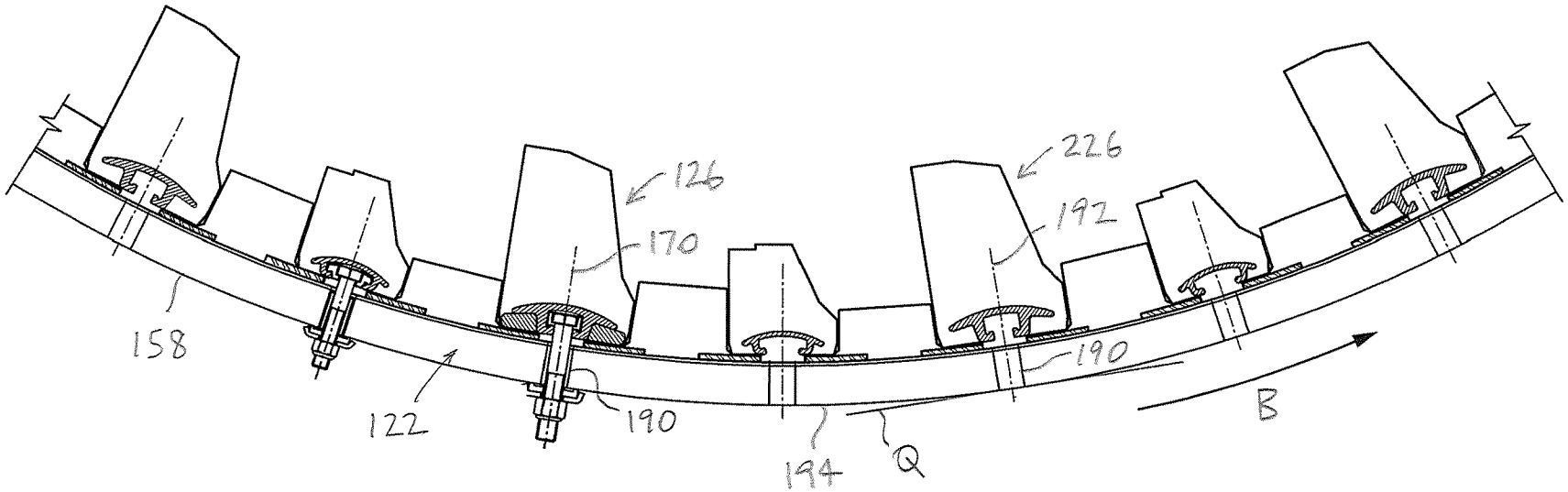
FIG. 3 is a partial cross-section of an embodiment of a mill assembly of the invention including embodiments of the liner system of the invention secured to the mill shell, drawn at a smaller scale.

It is also preferred that the bolt axis 170 is substantially aligned with a hole axis 192 when the bolt 136 is in its predetermined position, as will be described (FIG. 3).

As can be seen in FIGS. 2E and 2F, it is preferred that the lifter bar 120 includes a pair of lateral extensions (identified as 150A, 150B in FIGS. 2E and 2F). Each of the lateral extensions 150A, 150B respectively extends from the central portion 162 a predetermined distance 171 from the channel axis 160 (FIG. 2F). (It will be understood that the body 129 of the lifter bar 120 is omitted from FIG. 2F for clarity of illustration.) It is also preferred that the lifter bar 120 includes a pair of insert elements (identified as 166A, 166B in FIGS. 2E and 2F). The insert elements 166A, 166B are located on opposite sides of the channel axis 160 respectively. As can be seen in FIGS. 2E and 2F, each insert element 166A, 166B preferably is positioned between a selected one of the lateral extensions 150A, 150B and the inner surface 156 of the mill shell 122 to engage the selected ones of the lateral extensions 150A, 150B respectively, for resisting movement of the channel plate 130 outwardly toward the inner side 156 of the mill shell 122.

Referring to FIG. 2E, those skilled in the art would appreciate that tightening the nut 144 urges the outer washer 146 against the outer surface 158 of the mill shell 122, schematically represented by arrow "F". After the outer washer 146 engages the outer surface 156, further tightening of the nut on the bolt 136 urges the head 138 outwardly (i.e., in the direction indicated by arrow "G" in FIG. 2E), pulling the head 138 against the fixing washer 168, which is urged outwardly by the head to engage the outer arm 163. Because the outer arm 163 is an integral part of the channel plate 130, the pressure exerted by the head 138 outwardly against the outer arm 163 via the fixing washer 168 (i.e., in the direction indicated by arrow "G" in FIG. 2E) also causes the lateral extensions 150A, 150B to be urged outwardly, as schematically represented by arrows "$H_A$" and "$H_B$" in FIGS. 2E and 2F.

Figure 4A:
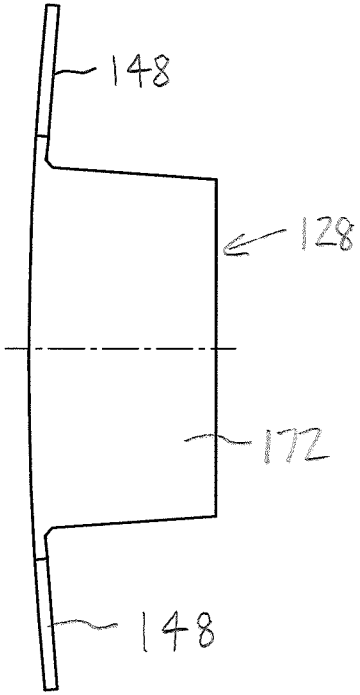
FIG. 4A is an end view of an embodiment of a shell plate of the invention, drawn at a larger scale.
Figure 4B:
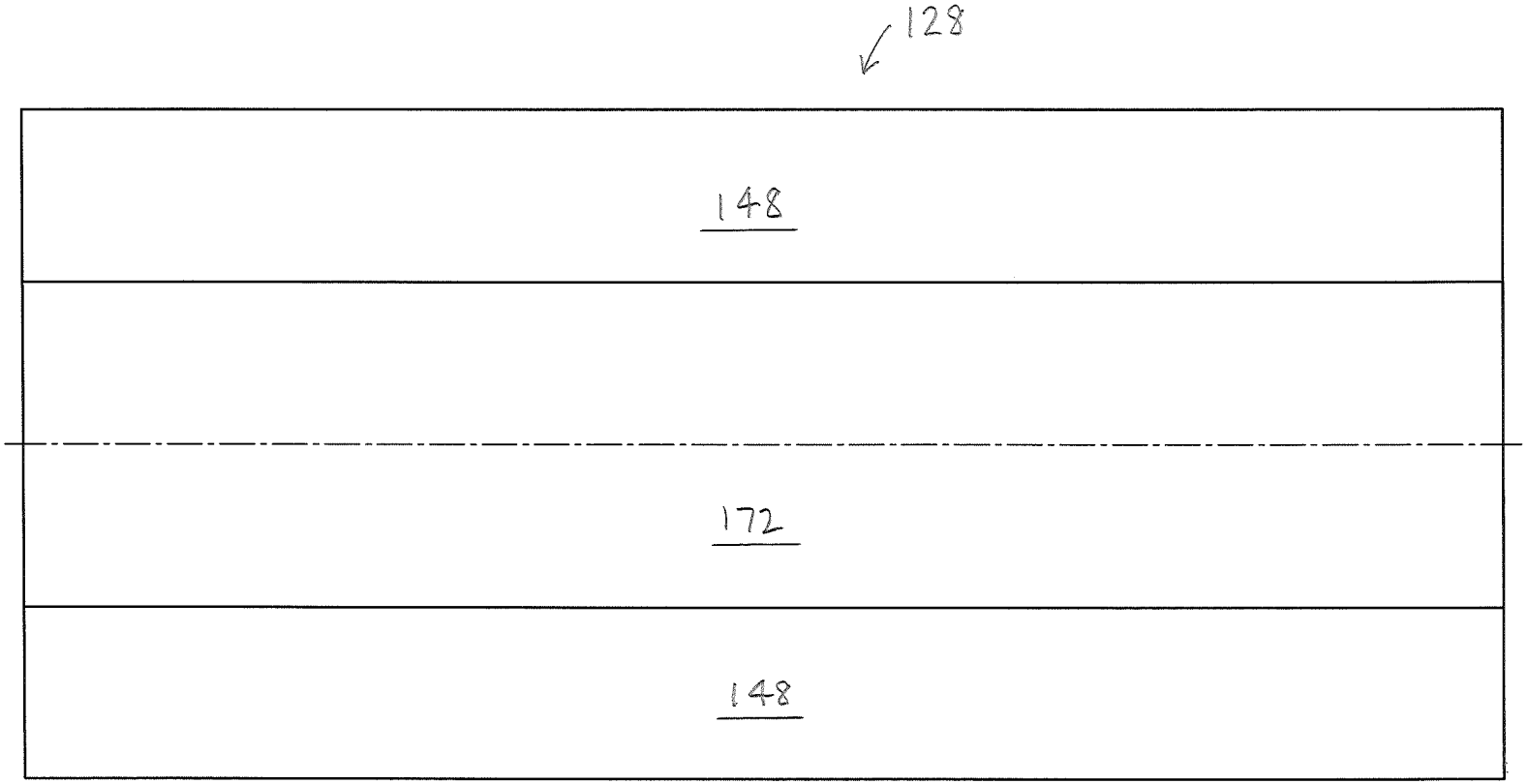
FIG. 4B is a plan view of an inner side of the shell plate of FIG. 4A.

Preferably, the liner system 126 additionally includes a number of shell plates. As can be seen in FIGS. 2E and 2F, the shell plates preferably are located with the lifter bar 120 therebetween. In FIGS. 2B and 2E, the shell plates located on opposite sides of the lifter bar 120 are identified by reference numerals 128A and 128B for clarity of illustration. Preferably, each shell plate 128 includes a main portion 172 and a toe portion 148 (FIGS. 4A, 4B). The toe portions included in the shell plates 128A, 128B are identified by reference numerals 148A, 148B respectively in FIGS. 2E and 2F for clarity of illustration. Each toe portion is located between one of the insert elements and the inner side 156 of the mill shell, to resist outward movement of the insert elements toward the inner side 156 of the mill shell 122. In addition, the main portions of the shell plates 128A, 128B are identified by reference characters 172A, 172B in FIG. 2F for clarity of illustration.

The insert elements 166A, 166B are positioned and configured to resist such respective outward movement of the lateral extensions 150A, 150B. As can be seen in FIGS. 2E and 2F, the insert element 166A preferably is located between the lateral extension 150A and the inner side 156 of the mill shell, and the insert element 166B preferably is located between the lateral extension 150B and the inner side 156. In particular, each of the insert elements 166A, 166B preferably is sized and positioned to resist movement of the lateral extension 150A, 150B that it is engaged with respectively.

It is preferred that the insert elements 166A, 166B are made of any suitable non-resilient material, or materials. For instance, the insert elements 166A, 166B may be made of suitable ceramics, composites, metals, or alloys.

As can be seen in FIG. 2F, due to the impacts of the solid parts of the charge colliding with the body 129 as the mill shell 122 rotates, the lateral extensions 150A, 150B are urged to pivot about a point identified (for exemplary purposes) as "1Y". (It will be understood that, in practice, the pivoting motion urged by the solid parts of the charge colliding with the body 129 may also, or instead, be about one or more points located other than at "1Y" in FIG. 2F.) As noted above, the solid parts of the charge collide with the body 129 in a number of directions. The directions in which the lateral extensions 150A, 150B are so urged are schematically indicated by arrows "$J_A$", "$J_B$" in FIGS. 2E and 2F respectively. Preferably, the insert elements 166A, 166B are sized and positioned to be substantially aligned with the outward pivoting movement of the lateral extensions 150A, 150B that is urged by the collisions of the solid parts of the charge with the body 129 as the mill shell 122 rotates, to resist such outward pivoting movement.

It will be understood that the channel plate 130 may be provided in any suitable form. Those skilled in the art would appreciate that the channel plate 130 may extend longitudinally along the lifter bar body 129 a predetermined distance (FIG. 2A). For example, the channel plate 130 may extend along substantially the entire length of the lifter bar body 129. As can be seen in FIG. 2G, in one embodiment, the central portion 162 of the channel plate 130 preferably includes an inner part 173 and a central body 174 extending outwardly from the inner part 173. The central body 174 is partially defined by exterior surfaces 176A, 176B (FIG. 2G). (The outer arm 163 preferably is included in the central body 174.) In addition, the lateral extensions 150A, 150B preferably are partially defined by respective outward surfaces 178A, 178B thereof.

Figure 2C:
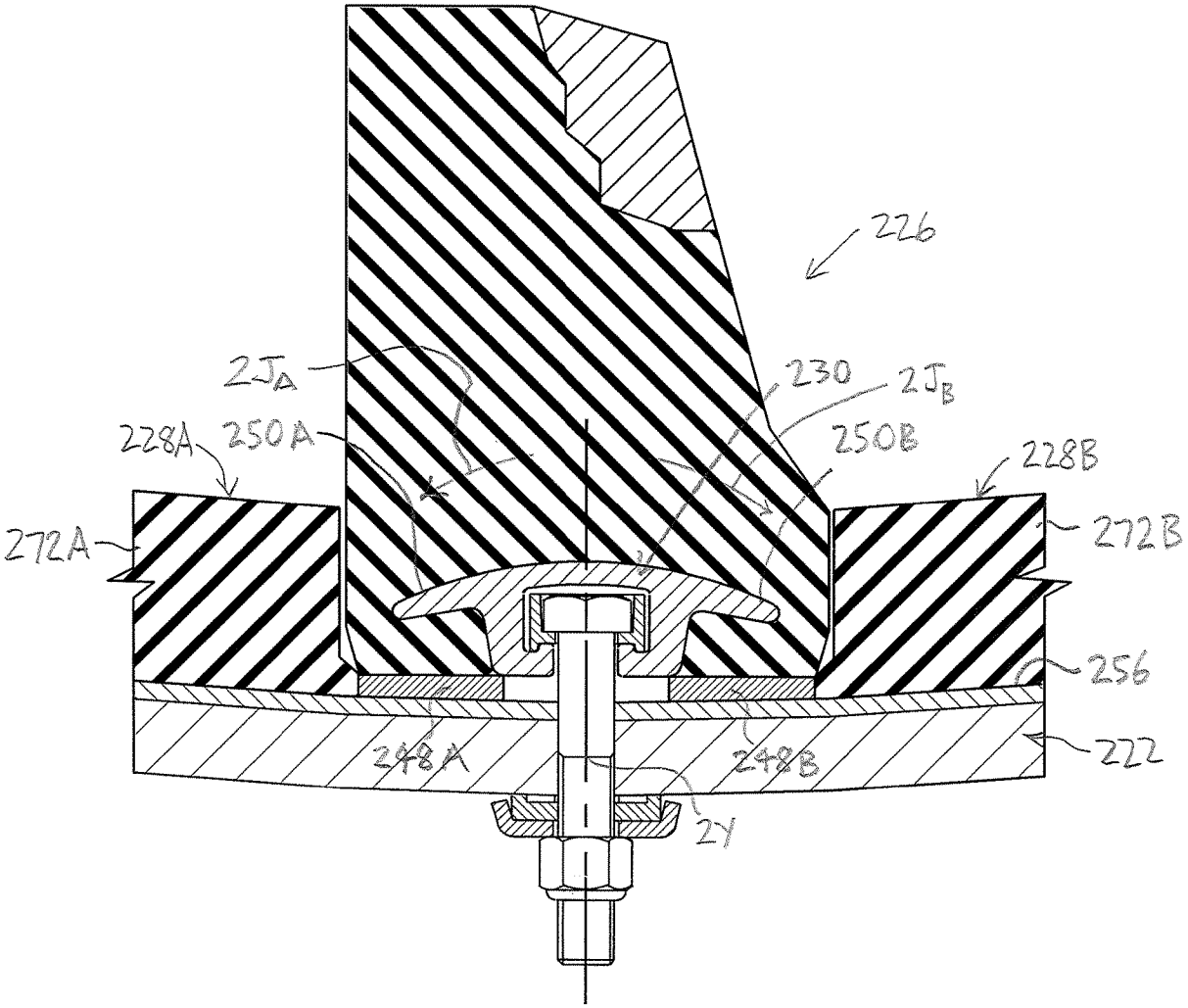
FIG. 2C is a cross-section of an alternative embodiment of the lifter bar of the invention.
Figure 2D:
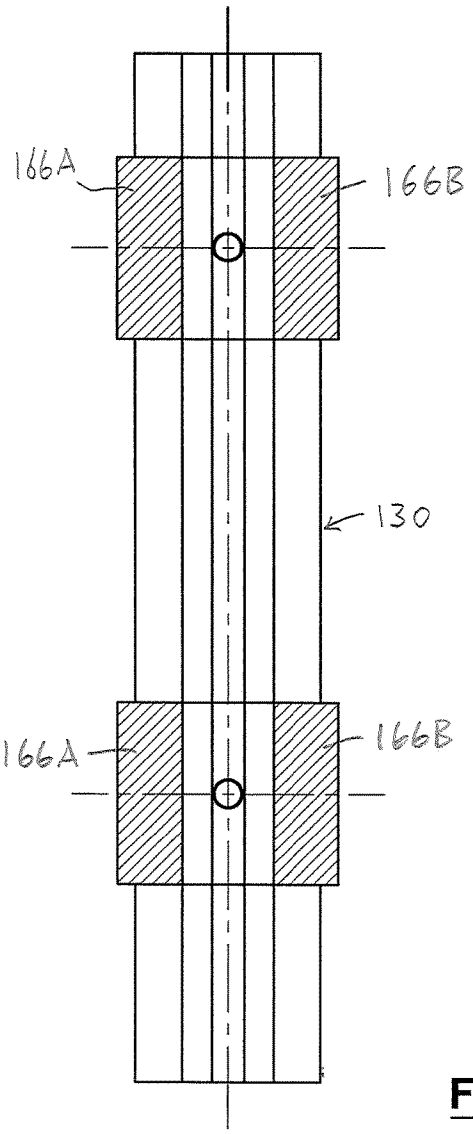
FIG. 2D is a bottom view of the lifter bar of FIG. 2A, showing the channel therein, drawn at a smaller scale.
Figure 2E:
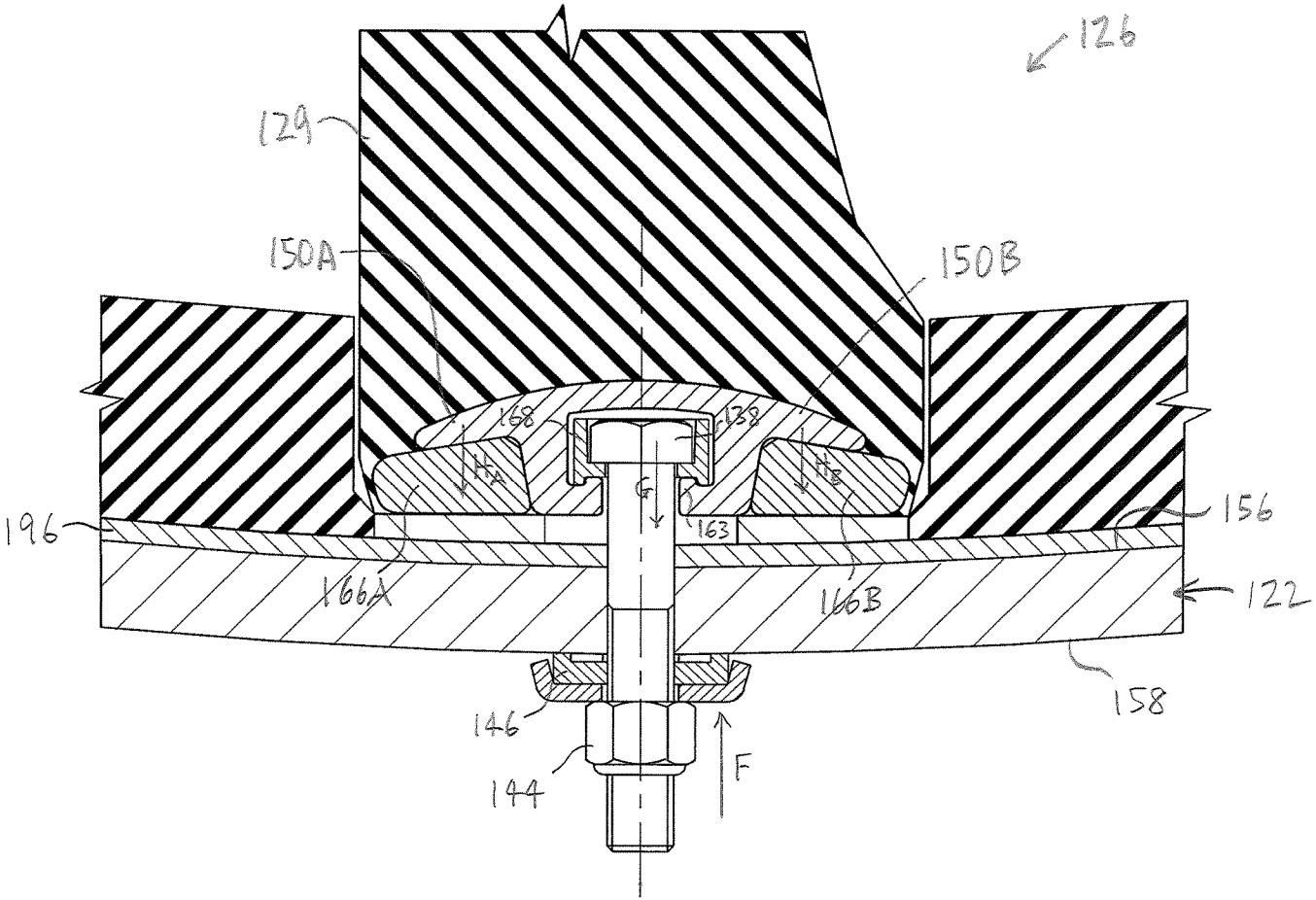
FIG. 2E is a cross-section of a portion of the liner system of FIGS. 2A and 2B, drawn at a larger scale.
Figure 2F:
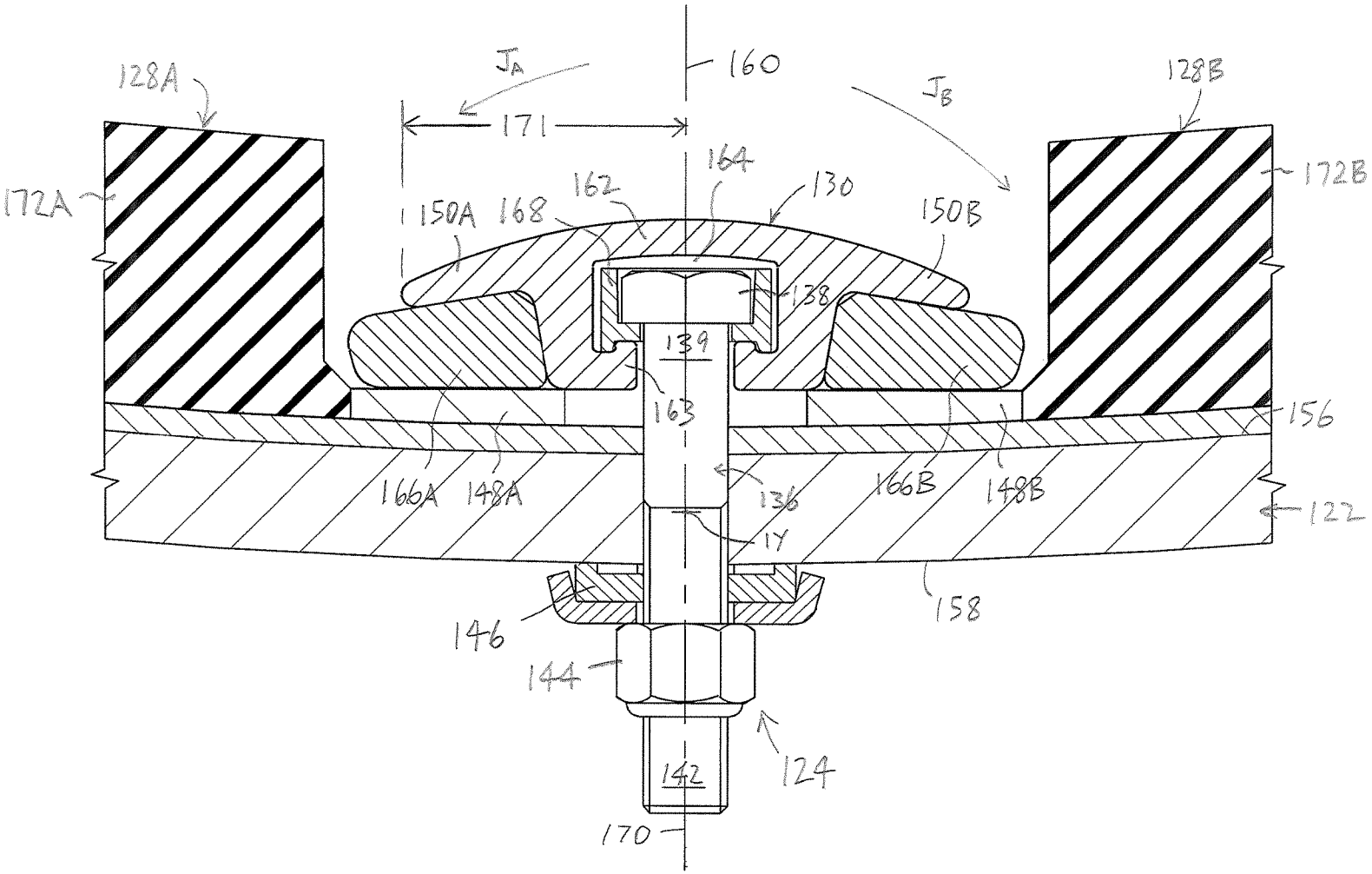
FIG. 2F is a cross-section of certain elements of the liner system of FIGS. 2A, 2B, and 2E, drawn at a larger scale.
Figure 2G:
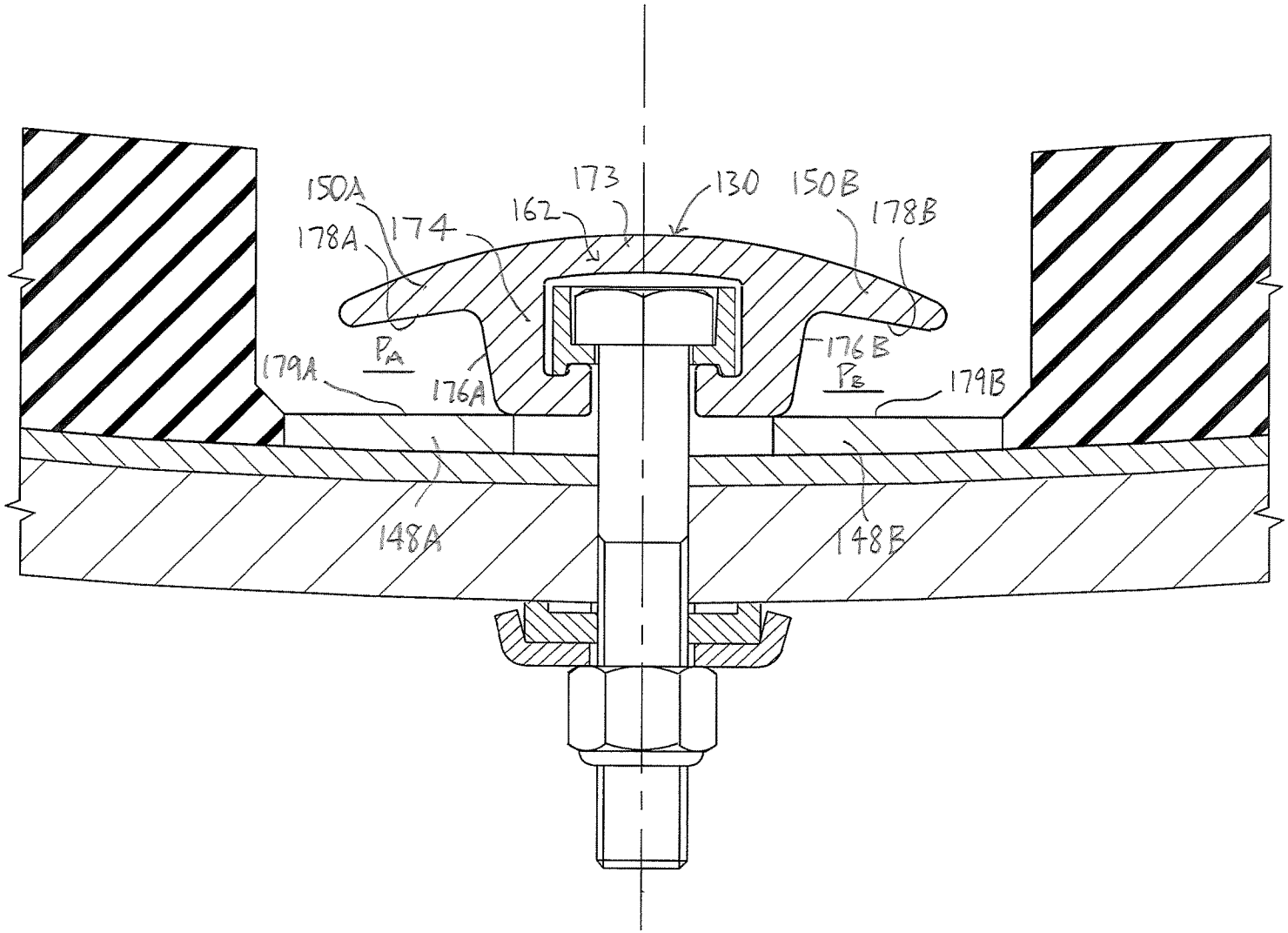
FIG. 2G is a cross-section of selected ones of the elements of FIG. 2F.
Figure 2H:
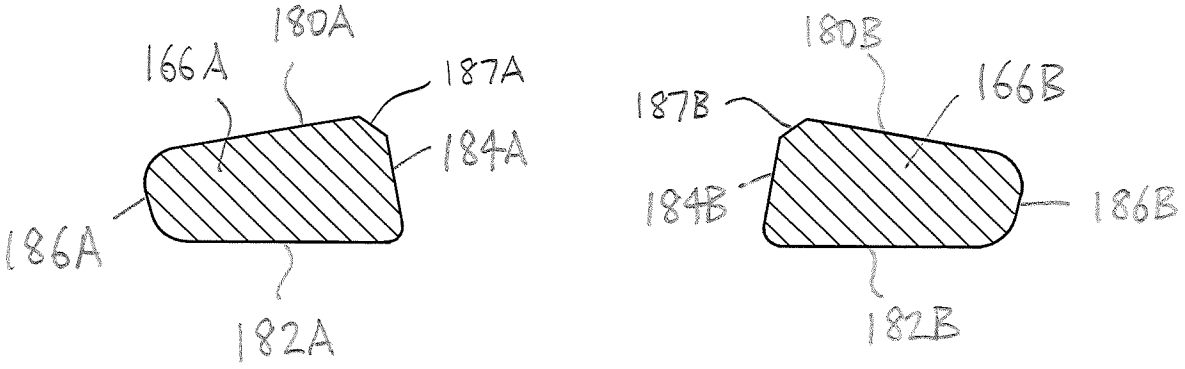
FIG. 2H is a cross-section of embodiments of the insert elements of the invention.

As can also be seen in FIGS. 2F, 2G, and 2H, it is preferred that each of the insert elements 166A, 166B is configured to fit between the central body 174, the respective lateral extensions 150A, 150B, and the toe portions 148A, 148B. The exterior surface 176A, the outward surface 178A, and an inner surface 179A of the toe portion 148A collectively define a pocket "$P_A$" (FIG. 2G) in which the insert element 166A fits relatively securely. Similarly, a pocket "$P_B$" in which the insert element 166B fits is defined by the exterior surface 176B, the outward surface 178B, and an inner surface 179B of the toe portion 1488 (FIG. 2G).

As illustrated in FIG. 2H, the insert element 166A preferably is defined by opposed inner and outer surfaces 180A, 182A and opposed central and non-central surfaces 184A, 186A. As can be seen in FIGS. 2E, 2F, and 2G, the insert element 166A preferably is formed so that certain of the surfaces thereof mate with the respective surfaces they engage with, when the insert element is positioned in its pocket "$P_A$". For instance, the outer surface 182A mates with the inner surface 179A of the toe portion 148A, and the inner surface 180A mates with the outward surface 178A of the lateral extension 150A. The central surface 184A mates with and engages the external surface 176A of the central body 174.

Similarly, the insert element 166B preferably is defined by opposed inner and outer surfaces 180B, 182B and opposed central and non-central surfaces 184B, 186B (FIG. 2H). As can be seen in FIGS. 2E, 2F, and 2G, the insert element 166B preferably is formed so that certain of the surfaces thereof mate with the respective surfaces they engage with, when the insert element is positioned in its pocket "$P_B$". For instance, the outer surface 182B mates with the inner surface 179B of the toe portion 148B, and the inner surface 180B mates with the outward surface 178B of the lateral extension 150B. The central surface 184B mates with and engages the external surface 176B of the central body 174.

In one embodiment, the insert elements 166A, 166B preferably include respective chamfer surfaces 187A, 187B. The chamfer surfaces 187A, 187B provide clearance or a small gap between portions of the insert elements 166A, 166B and the mating surfaces of the central body 174 and the lateral extensions 150A, 150B, to facilitate positioning of the insert elements 166A, 166B in the respective pockets "$P_A$", "$P_B$".

From the foregoing, it can be seen that the insert elements 166A, 166B are positioned and formed to resist outward pivoting movements of the lateral extensions (and therefore such movements of the channel plate) due to dynamic impacts of the solid parts of the charge on the lifter bar body. As noted above, in the prior art, it is believed that the failure of the bolt is attributable to initially small rotational or pivoting outward movement of the lateral extensions due to the impact of the solid parts of the charge on the body 129. In the prior art, it is also believed that these small outward pivoting movements ultimately result in relatively larger outward pivoting movements of the channel plate relative to the mill shell that repeatedly subject the bolt to torque, ultimately resulting in failure of the bolt, due to metal fatigue. From FIG. 2F, however, it can be seen that the insert elements 166A, 166B resist outward movement of the respective lateral extensions 150A, 150B. As a result, in the lifter bar 120, the ability of the channel plate to pivot is restricted, and the risk of failure of the bolt is reduced accordingly.

From the foregoing, it can also be seen that the lifter bar 120 of the liner system 126 preferably includes an inner portion "IP" thereof (i.e., the body 129) that includes rubber, and an outer portion "OP" thereof (i.e., the insert elements 166A, 166B) including substantially non-resilient material(s) located at least partially between the channel plate 130 and the inner side 156 of the mill shell 122 (FIG. 2B). Accordingly, the lifter bar 120 of the invention has the advantage that its inner portion, which is subjected to collisions with the solid parts of the charge when the mill shell is rotating, is at least partially resilient. However, the lifter bar 120 also has the additional advantage that its outer portion includes substantially non-resilient elements (i.e., the insert elements 166A, 166B) that resist outward pivoting movement of the channel plate 130, thereby indirectly supporting the bolt, resulting in a longer useful life for the bolt.

As can be seen in FIG. 3, the bolt 136 preferably is at least partially positioned in a hole 190 in the mill shell 122 defining the hole axis 192 thereof. It will be understood that the outer side 158 of the mill shell 122 is at least partially defined by an arc 194. The hole axis 192 is substantially orthogonal to a plane ("Q") tangential to the arc 194 at the intersection of the hole axis 192 and the arc 194 of the outer side 158 of the mill shell 122. The bolt axis 192 preferably is aligned with the hole axis 170 when the bolt 136 is in the predetermined position relative to the mill shell 122.

In one embodiment, the insert elements 166A, 166B preferably are secured to the channel plate 130. The insert elements may be secured to the channel plate 130 using any suitable means. For instance, the insert elements 166A, 166B may be welded to the lateral extensions 150A, 1508 respectively.

Preferably, the channel plate 130 and the insert elements 166A, 166B are made of aluminum. Alternatively, the channel plate 130 and the insert elements 166A, 166B may be made of steel, or of any other suitable material(s). As noted above, the channel plate 130 and the insert elements 166A, 166B may be made of steel, or of any other suitable material(s).

It is preferred that each of the toe portions 148A, 148B is made of steel. Preferably, the main portions 172A, 172B are made of rubber.

As can be seen in FIG. 2E, the liner system 126 preferably includes a layer 196 of steel that is located between the respective toe portions 148A, 148B and the inner side 156 of the mill shell 122.

As can be seen in FIG. 2A, the lifter bar 120 preferably has a length "L", and the attachment assemblies are located at the holes 190 (not shown in FIG. 2A) along the length "L" where bolts may be positioned through the mill shell. For clarity of illustration, the locations of two hole axes 192 are shown in FIG. 2A. In FIG. 2D, the outer side of the channel plate 130 can be seen, with the insert elements 166A, 166B. Although the channel plate 130 as illustrated in FIG. 2D is configured for attachment to the mill shell 122 at two locations, it will be understood that the lifter bar 120 may be secured to the mill shell 122 at as many locations as may be needed. In addition, those skilled in the art would appreciate that the liner system 126 preferably includes a number of the lifter bars 120, positioned radially relative to each other around the inner side of the mill shell, with the main portions of the shell plates located therebetween respectively. Accordingly, it will be understood that the liner system 126 preferably includes a number of attachment assemblies.

As can also be seen in FIG. 2A, the mill shell 122 is part of a grinding mill "GM" rotatable about a longitudinal axis thereof (not shown). Those skilled in the art would appreciate that the ore is introduced at a feed end "FE" and the portion of the ore pieces in the charge that has been reduced to the minimum acceptable particle size exits the grinding mill "GM" at the discharge end "DE" (FIG. 2A).

In use, an embodiment of a method of maintaining the bolt 136 in the predetermined position securing the lifter bar 120 in the rotatable mill shell 122 preferably includes providing the channel plate 130 to be secured to the body 129 of the lifter bar 120. The method preferably also includes securing the insert elements 166A, 166B (located respectively between the lateral extensions 150A, 150B and the inner side 156 of the mill shell 122) to the selected lateral extensions 150A, 150B respectively, for resisting outward movement of the lateral extensions 150A, 150B toward the inner side 156 of the mill shell 122. As described above, the lifter bar 120 preferably is secured to the mill shell 122 by the attachment assembly 124. Due to the insert elements 166A, 166B, which are positioned and formed to resist outward pivoting movements of the lateral extensions 150A, 1508, the bolt 136 is maintained in its predetermined position, i.e., the bolt 136 is maintained so that its axis is substantially aligned with the channel axis 160.

An alternative embodiment of the liner system 226 of the invention is illustrated in FIG. 2C. In this embodiment, the insert elements are omitted. However, the liner system 226 preferably includes shell plates 228A, 228B. Each shell plate 228A, 228B preferably includes a main portion 272A, 272B respectively that is made of rubber, and a toe portion 248A, 248B respectively that is made of steel, or any other suitable substantially non-resilient material(s). It is preferred that each toe portion is located between a channel plate 230 and an inner side 256 of a mill shell 222, to resist outward movement of the channel plate 230 toward the inner side 256 of the mill shell 222.

As described above, when the mill shell 222 rotates, the solid parts of the charge (not shown in FIG. 2C) collide with a body 229 of the lifter bar 220, urging the lateral extensions 250A, 250B to pivot outwardly, as indicated by arrows "$2J_A$" and "$2J_B$" in FIG. 2C respectively. A point "2Y" is identified in FIG. 2C about which such outward pivoting movement may be urged, for exemplary purposes. (It will be understood that, in practice, the pivoting motion urged by the solid parts of the charge colliding with the body 229 may also, or instead, be about one or more points located other than at "2Y" in FIG. 2C.) Because the non-resilient toe portions 248A, 248B are positioned between the respective lateral extensions 250A, 250B and an inner side 256 of the mill shell 222, the toe portions 248A, 248B resist outward pivoting movement of the lateral extensions 250A, 250B.

Figure 7A:
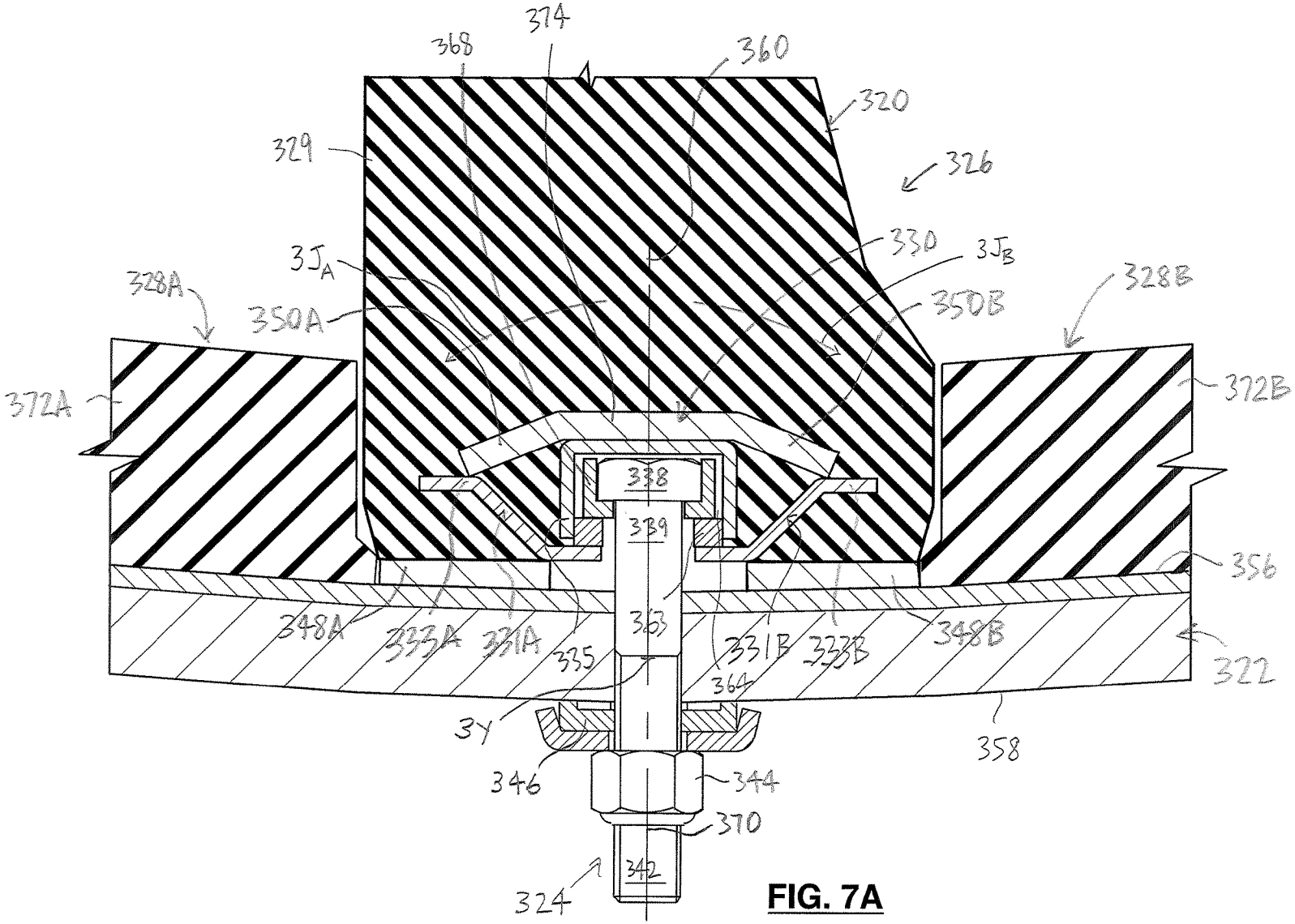
FIG. 7A is a cross-section of a portion of another alternative embodiment of a liner system of the invention, drawn at a larger scale.
Figure 7B:
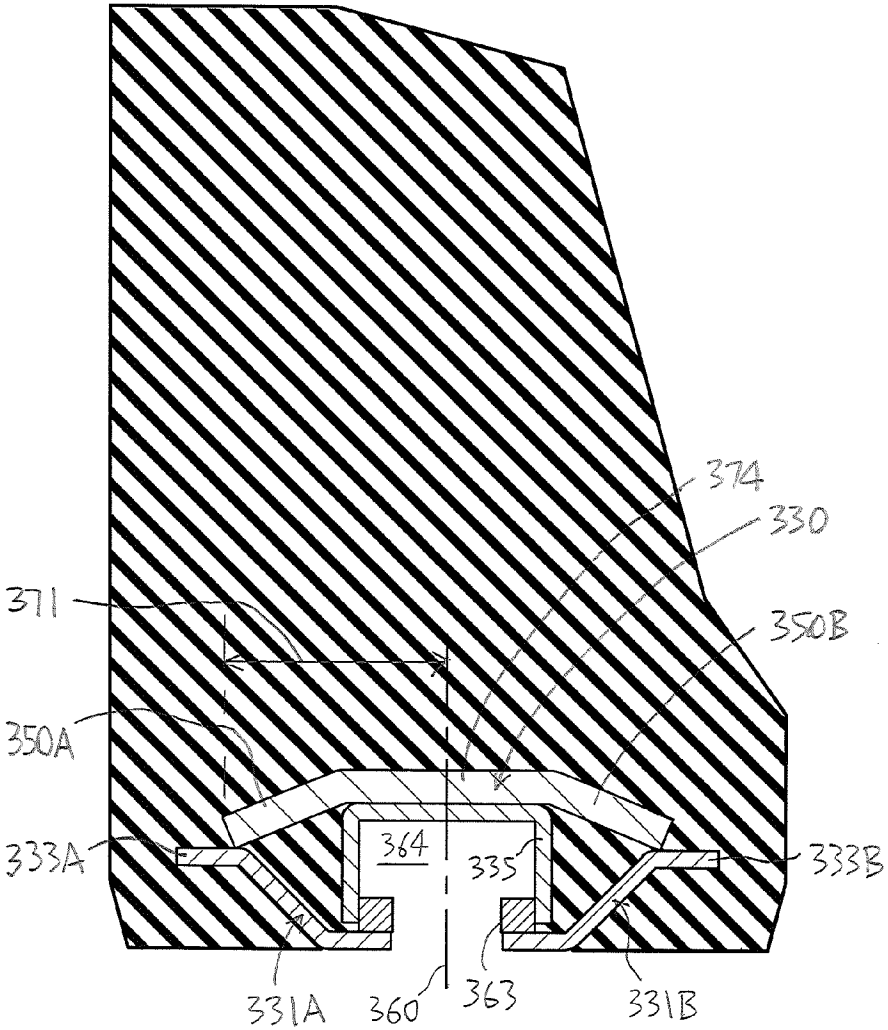
FIG. 7B is a cross-section of the lifter bar of FIG. 7A, drawn at a smaller scale.

An alternative embodiment of the liner system 326 of the invention is illustrated in FIGS. 7A and 7B. Preferably, the liner system 326 includes one or more lifter bars 320. It is preferred that the lifter bar 320 includes a body 329 and a channel inner plate 330 secured to the body 329 and partially defining a channel axis 360. The channel inner plate 330 preferably includes a central portion 374 thereof and a pair of lateral extensions 350A, 350B, each lateral extension 350A, 350B extending from the central portion 374 (FIG.

7A) a predetermined distance 371 from the channel axis 360 respectively (FIG. 7B). The lifter bar 320 preferably also includes a pair of channel outer plates 331A, 331B secured to the body 329 and positioned between the channel inner plate 330 and an inner side 356 of a mill shell 322. Each channel outer plate preferably includes respective outer portions 333A, 333B positioned to engage the respective transverse portions 350A, 350B, to resist movement of the respective transverse portions 350A, 350B outwardly toward the inner side 356 of the mill shell 322.

The lifter bar 320 preferably also includes a channel central housing 335 at least partially positioned between the channel inner plate 330 and the channel outer plates 331A, 331B for resisting pivoting outward movement of the channel inner plate 330 toward the inner side of the mill shell. The channel central housing 335 preferably includes one or more outer arms 363 and a cavity 364 therein that is at least partially defined by the outer arm 363. Preferably, the liner system 326 also includes one or more attachment assemblies 324. It is preferred that the attachment assembly 324 includes a fixing washer 368 at least partially positioned in the cavity 364 and engaged with the outer arm 363, the outer arm 363 being formed to resist movement of the fixing washer 368 outwardly toward the inner side 356 of the mill shell 322. It is also preferred that the attachment assembly 324 includes a bolt 336 defining a bolt axis 370 and extending between inner and outer ends 339, 342 thereof, the bolt including a head 338 at the inner end 339 engageable with the fixing washer 368. The bolt 336 is positionable in a predetermined position relative to the mill shell 322 in which the bolt axis 370 is substantially aligned with the channel axis 360, with the inner end 339 engaged with the fixing washer 368 and the outer end 342 positioned outside the mill shell 322. The attachment assembly 324 preferably also includes a nut 344 threadably engageable with the bolt 336 at the bolt's outer end 342, and an outer washer 346 between the nut 344 and the outer side 358 of the mill shell 322. The outer washer 346 is engageable with the outer side 358 of the mill shell 322 when the nut 344 is tightened, to subject the bolt 336 to tension, to urge the head outwardly toward the inner side of the mill shell, securing the lifter bar 320 inside the mill shell 322. As can be seen in FIGS. 7A and 7B, the channel outer plates 331A, 331B preferably are configured to maintain the bolt 336 in the predetermined position.

As can be seen in FIGS. 7A and 7B, the body 329 preferably includes outer portions 398A, 398B that are positioned between the respective channel outer plates 331A, 331B and the inner side 356 of the mill shell 322.

As described above, when the mill shell is rotating, certain of the solid parts of the charge (not shown in FIG. 7A) collide with the body 329 and urge the channel inner plate 330 to pivot outwardly about a point identified (for exemplary purposes) as "3Y" in FIG. 7A. (It will be understood that, in practice, the pivoting motion urged by the solid parts of the charge colliding with the body 329 may also, or instead, be about one or more points located other than at "3Y" in FIG. 7A.) The general directions in which the channel inner plate 330 is so urged to move are indicated by arrows "$3J_A$", "$3J_B$" in FIG. 7A. Preferably, the channel outer plates 331A, 331B are made of any suitable non-resilient material, e.g., steel. The channel outer plates 331A, 331B are formed and positioned to resist outward pivoting movement of the channel inner plate 330 that is urged in the directions indicated by arrows "$3J_A$", "$3J_B$" in FIG. 7A.

It is also preferred that the liner system 326 includes a number of shell plates including first and second shell plates 328A, 328B located with the lifter bar 320 therebetween (FIGS. 7A, 7B). As can be seen in FIGS. 7A and 7B, each of the shell plates preferably includes a main portion and a toe portion. For clarity of illustration, in FIGS. 7A and 7B, the main portions of the shell plates 328A, 328B are identified by reference characters 372A, 372B respectively, and the toe portions thereof are identified by reference characters 348A, 348B respectively. The toe portions 348A, 348B preferably are located between the channel outer plates 331A, 331B respectively and the inner side 356 of the mill shell, to resist outward movement of the channel outer plates 331A, 331B toward the inner side of the mill shell.

Figure 5A:
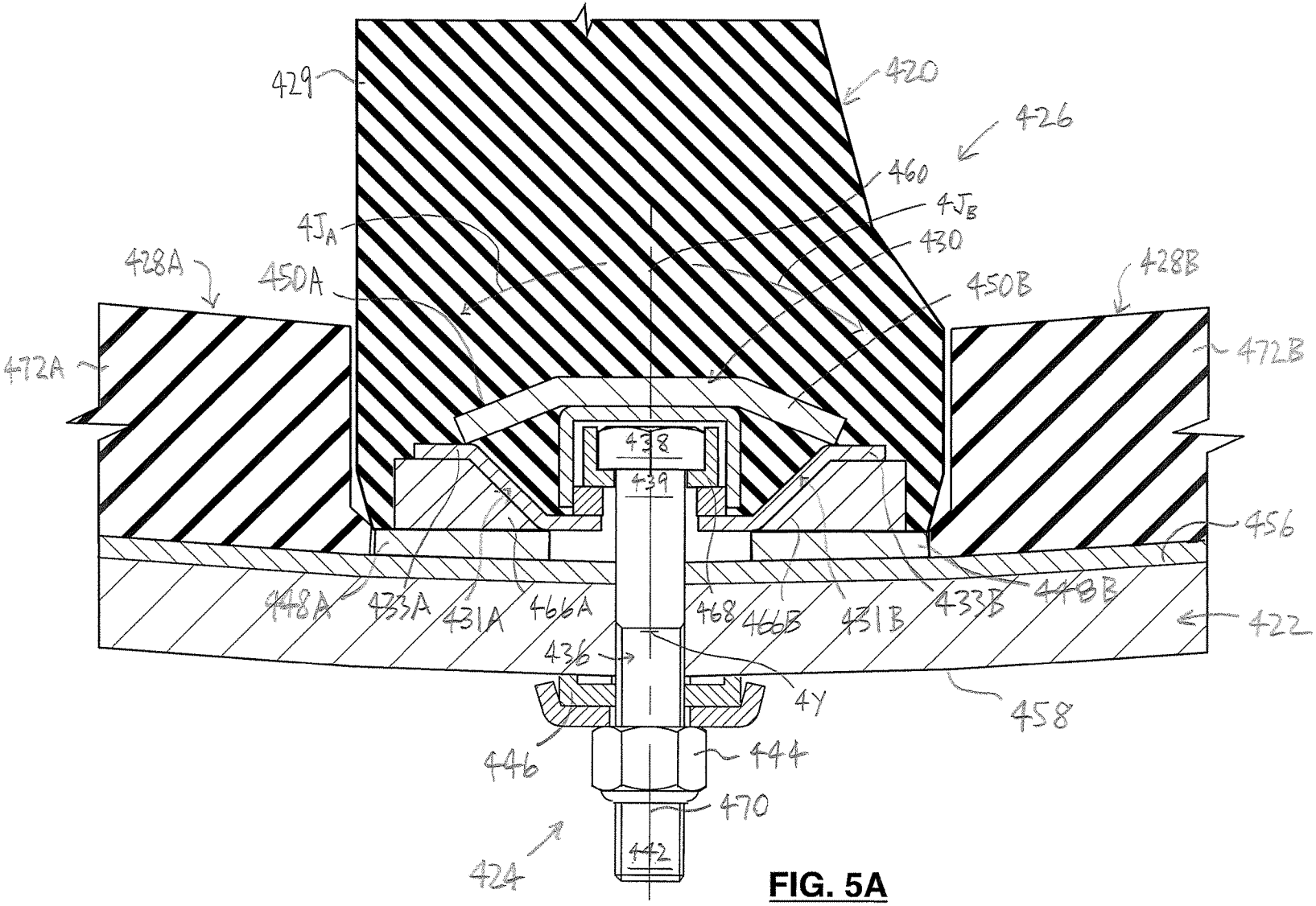
FIG. 5A is a cross-section of a portion of an alternative embodiment of the liner system of the invention including an alternative embodiment of the lifter bar of the invention, drawn at a larger scale.
Figure 5B:
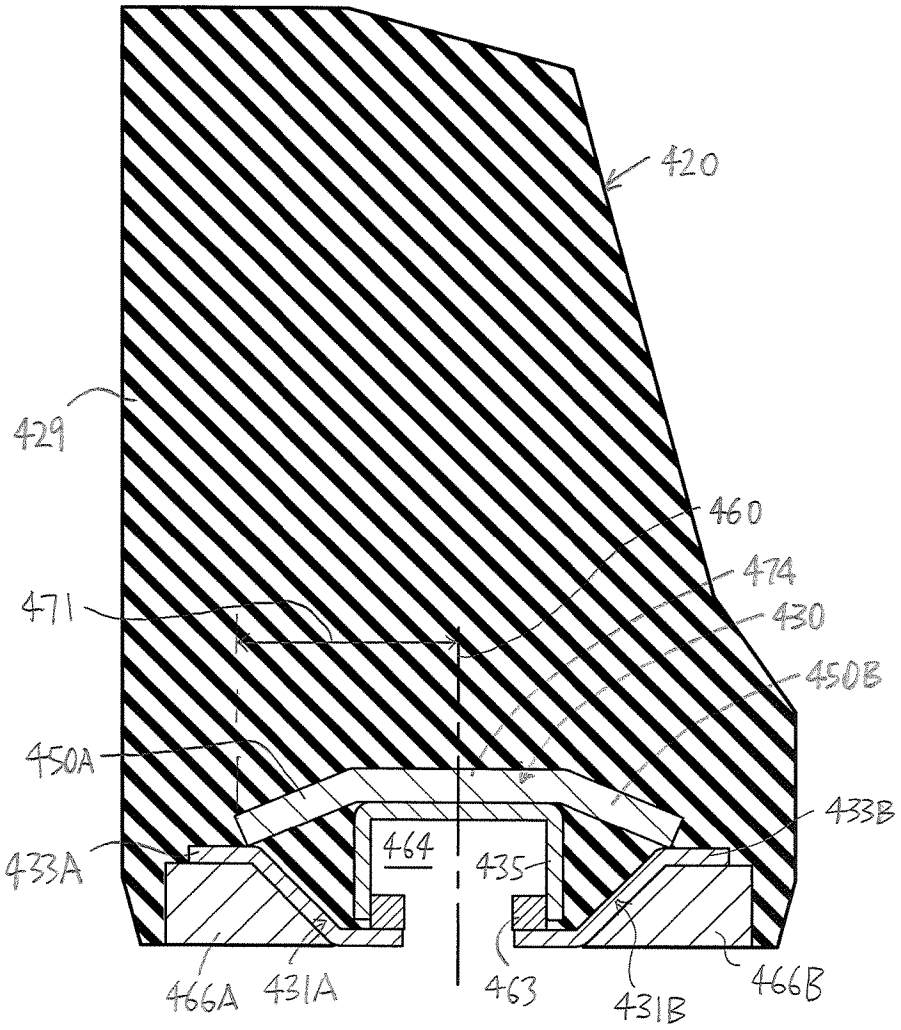
FIG. 5B is a cross-section of the lifter bar of FIG. 5A, drawn at a smaller scale.

In another alternative embodiment illustrated in FIGS. 5A and 5B, the liner system 426 of the invention preferably includes one or more lifter bars 420, and one or more attachment assemblies 424. It is preferred that the lifter bar 420 includes a body 429 and a channel inner plate 430 secured to the body 429 and partially defining a channel axis 460 (FIG. 5B). Preferably, the channel inner plate 430 includes a central portion 474 thereof (FIG. 5B) and a pair of lateral extensions 450A, 450B (FIGS. 5A, 5B). Each of the lateral extensions 450A, 450B extends from the central portion 474 a predetermined distance 471 from the channel axis 460 respectively (FIG. 5B). As can be seen in FIGS. 5A and 5B, the lifter bar 420 preferably also includes a pair of channel outer plates 431A, 431B secured to the body 429 and positioned between the channel inner plate 430 and an inner side 456 of a mill shell 422. Each channel outer plate 431A, 431B preferably includes respective outer portions 433A, 433B positioned to engage the respective transverse portions 450A, 450B, to resist movement of the respective transverse portions 450A, 450B outwardly toward the inner side 456 of the mill shell 422.

It is also preferred that the lifter bar 420 includes a channel central housing 435 (FIG. 5B) at least partially positioned between the channel inner plate 430 and the channel outer plates 431A, 431B, for locating the channel inner plate 430. Preferably, the channel central housing 435 includes one or more outer arms 463 and a cavity 464 therein that is at least partially defined by the outer arm 463 (FIG. 5B). The lifter bar 420 preferably also includes a pair of insert elements 466A, 466B respectively positioned between the outer portions 433A, 433B of the channel outer plates 431A, 431B and the inner surface 456 of the mill shell 422 to resist movement of the respective transverse portions 450A, 450B outwardly. The attachment assembly 424 preferably includes a fixing washer 468 at least partially positioned in the cavity 464 and engaged with the outer arm 463, the outer arm 463 being formed to resist movement of the fixing washer 468 outwardly toward the inner side 456 of the mill shell. The attachment assembly 424 preferably includes a bolt 436 defining a bolt axis 470 and extending between inner and outer ends 439, 442. The bolt 436 includes a head 438 at the inner end 439 engageable with the fixing washer 468, the bolt 436 being positionable in a predetermined position relative to the mill shell 422 in which the bolt axis 470 is substantially aligned with the channel axis 460, with the inner end 439 engaged with the fixing washer 468 and the outer end 442 positioned outside the mill shell 422. In addition, the attachment assembly 424 preferably includes a nut 444 threadably engageable with the bolt 436 at the bolt's outer end 442, and an outer washer 446 between the nut 444 and an outer side 458 of the mill shell 422. Preferably, the outer washer 446 is engageable with the outer side 458 of the mill shell 422 when the nut 444 is tightened, to subject the bolt 436 to tension, to urge the head 438 outwardly toward the inner side 456 of the mill shell 422, securing the lifter bar

420 inside the mill shell 422. The channel outer plates 431A, 431B and the insert elements 466A, 466B preferably are configured to maintain the bolt 436 in the predetermined position.

As described above, when the mill shell is rotating, certain of the solid parts of the charge (not shown in FIG. 5A) collide with the body 429 and urge the channel inner plate 430 to pivot outwardly about a point identified (for exemplary purposes) as "4Y" in FIG. 5A. (It will be understood that, in practice, the pivoting motion urged by the solid parts of the charge colliding with the body 429 may also, or instead, be about one or more points located other than at "4Y" in FIG. 5A.) The general directions in which the channel inner plate 430 is so urged to move are indicated by arrows "$4J_A$", "$4J_B$" in FIG. 5A.

As described above, the channel outer plates 431A, 431B and the insert elements 466A, 466B are formed and positioned to resist the pivoting outward movement of the channel inner plate 430.

As can also be seen in FIG. 5A, the liner system 426 preferably includes a number of shell plates comprising first and second shell plates 428A, 428B located with the lifter bar 420 therebetween. The shell plates preferably include respective main portions 472A, 472B and toe portions 448A, 448B. The toe portions are located between the insert elements 466A, 466B respectively and the inner side of the mill shell, to resist outward movement of the insert elements toward the inner side of the mill shell.

Figure 6:
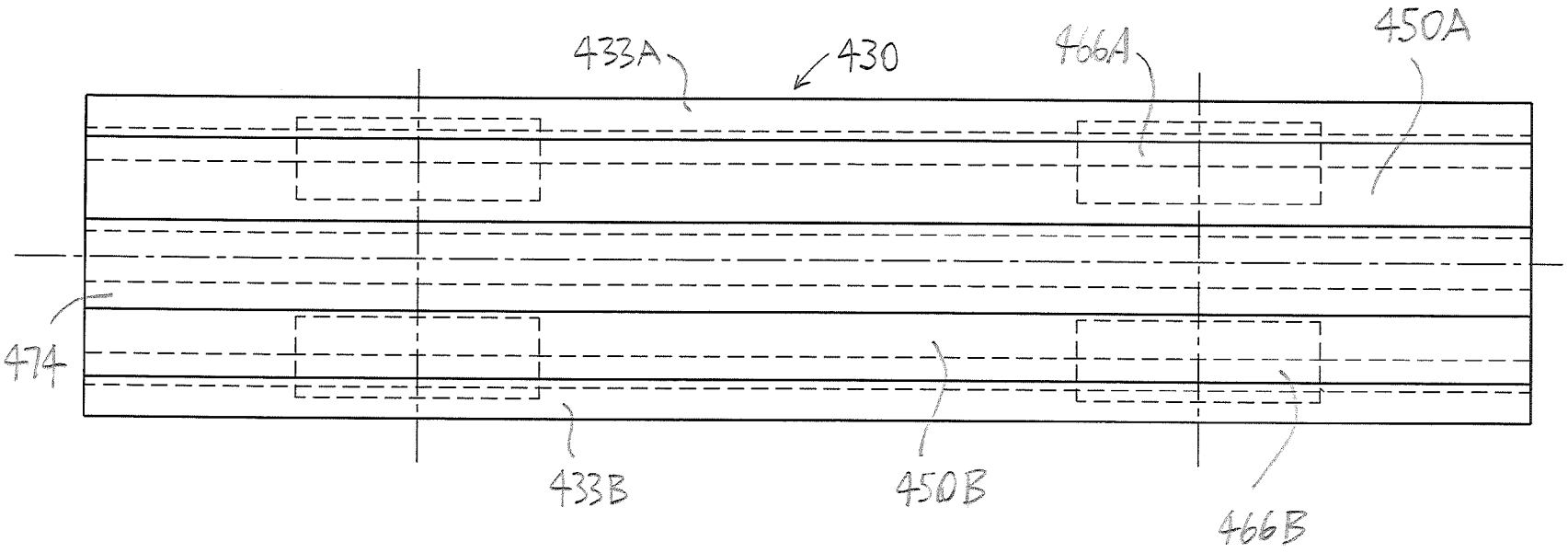
FIG. 6 is a plan view of the channel inner plate included in the lifter bar of FIGS. 5A and 5B, drawn at a smaller scale.

As can be seen in FIG. 6, the insert elements 466A, 466B preferably each extend longitudinally a certain distance.

It will be understood that a number of the embodiments of the liner system described herein may be installed in the same mill shell. One such arrangement is illustrated in FIG. 3. In FIG. 3, an embodiment of a mill shell assembly 595 is illustrated that includes the liner systems 126 and 226. It will be understood that certain of the attachment assemblies are omitted from FIG. 3 for clarity of illustration.

It will also be appreciated by those skilled in the art that the invention can take many forms, and that such forms are within the scope of the invention as claimed. The scope of the claims should not be limited by the preferred embodiments set forth in the examples, but should be given the broadest interpretation consistent with the description as a whole.

We claim:

1. A liner system for installation in a rotatable mill shell having an inner side and an opposed outer side, the liner system comprising:

at least one lifter bar comprising:

a body thereof;

a channel plate secured to the body and defining a channel axis;

the channel plate comprising a central portion aligned with the channel axis and at least one lateral extension extending transversely from the central portion in relation to the channel axis;

the channel plate additionally comprising at least one outer arm and a cavity that is at least partially defined by said at least one outer arm;

at least one insert element positioned between said at least one lateral extension and the inner side of the mill shell, for resisting outward movement of said at least one lateral extension toward the inner side;

at least one attachment assembly comprising:

a fixing washer at least partially positioned in the cavity and engaged with said at least one outer arm, said at least one outer arm being formed to resist movement of the fixing washer outwardly, toward the inner side of the mill shell;

a bolt defining a bolt axis and extending between inner and outer ends, the bolt comprising a head at the inner end engageable with the fixing washer, the bolt being positionable in a predetermined position relative to the mill shell in which the bolt axis is substantially aligned with the channel axis, with the inner end engaged with the fixing washer and the outer end positioned outside the mill shell;

a nut threadably engageable with the bolt at the bolt's outer end;

an outer washer between the nut and the outer side of the mill shell, and engageable with the outer side of the mill shell when the nut is tightened to subject the bolt to tension, to urge the head outwardly toward the inner side of the mill shell, securing the lifter bar inside the mill shell; and said at least one insert element being configured to maintain the bolt in the predetermined position.

2. The liner system according to claim 1 in which:

said at least one lateral extension comprises a pair of lateral extensions, each said lateral extension respectively extending from the central portion a predetermined distance from the channel axis; and said at least one insert comprises a pair of inserts, each said insert being located on opposite sides of the channel axis respectively, each said insert being positioned between a selected one of the lateral extensions and the inner surface of the mill shell to engage the selected ones of the lateral extensions respectively, for resisting movement of the channel plate outwardly toward the inner side of the mill shell.

3. The liner system according to claim 1 comprising a plurality of attachment assemblies.

4. The liner system according to claim 1 in which:

the bolt is at least partially positioned in a hole in the mill shell defining a hole axis thereof;

the outer side of the mill shell is at least partially defined by an arc;

the hole axis is substantially orthogonal to a plane tangential to the arc at the intersection of the hole axis and the arc of the outer side of the mill shell; and the bolt axis is aligned with the hole axis when the bolt is in the predetermined position relative to the mill shell.

5. The liner system according to claim 1 in which the channel plate and said at least one insert element comprise aluminum.

6. The liner system according to claim 1 in which said at least one insert element is secured to the channel plate.

7. The liner system according to claim 1 additionally comprising:

a plurality of shell plates comprising first and second shell plates located with said at least one lifter bar therebetween;

each said shell plate comprising a main portion and a toe portion; and each said toe portion being located between said at least one insert element and the inner side of the mill shell, to resist outward movement of said at least one insert element toward the inner side of the mill shell.

8. The liner system according to claim 7 in which each said toe portion comprises steel.

9. The liner system according to claim 7 in which each said main portion comprises rubber.

10. The liner system according to claim 1 in which the body of the lifter bar comprises rubber.

11. The liner system according to claim 7 additionally comprising a layer of steel located between the respective toe portions and the inner side of the mill shell.

12. A liner system for installation in a rotatable mill shell having an inner side and an opposed outer side, the liner system comprising:

at least one lifter bar comprising:

a body;

a channel inner plate secured to the body and partially defining a channel axis, the channel inner plate comprising a central portion thereof and a pair of lateral extensions, each said lateral extension extending from the central portion a predetermined distance from the channel axis respectively;

a pair of channel outer plates secured to the body and positioned between the channel inner plate and the inner side of the mill shell, each said channel outer plate comprising respective outer portions positioned to engage the respective transverse portions, to resist movement of the respective transverse portions outwardly toward the inner side of the mill shell;

a channel central housing at least partially positioned between the channel inner plate and the channel outer plates for resisting outward movement of the channel inner plate toward the inner side of the mill shell, the channel central housing comprising at least one outer arm and a cavity therein that is at least partially defined by said at least one outer arm;

at least one attachment assembly comprising:

a fixing washer at least partially positioned in the cavity and engaged with said at least one outer arm, said at least one outer arm being formed to resist movement of the fixing washer outwardly toward the inner side of the mill shell;

a bolt defining a bolt axis and extending between inner and outer ends, the bolt comprising a head at the inner end engageable with the fixing washer, the bolt being positionable in a predetermined position relative to the mill shell in which the bolt axis is substantially aligned with the channel axis, with the inner end engaged with the fixing washer and the outer end positioned outside the mill shell;

a nut threadably engageable with the bolt at the bolt's outer end;

an outer washer between the nut and the outer side of the mill shell, and engageable with the outer side of the mill shell when the nut is tightened, to subject the bolt to tension, to urge the head outwardly toward the inner side of the mill shell, securing the lifter bar inside the mill shell; and the channel outer plates being configured to maintain the bolt in the predetermined position.

13. The liner system according to claim 12 additionally comprising:

a plurality of shell plates comprising first and second shell plates located with said at least one lifter bar therebetween;

each of said shell plates comprising a main portion and a toe portion; and each said toe portion being located between a selected one of the channel outer plates and the inner side of the mill shell, to resist outward movement of said selected one of the channel outer plates toward the inner side of the mill shell.

14. A liner system for installation in a rotatable mill shell having an inner side and an opposed outer side, the liner system comprising:

at least one lifter bar comprising:

a body;

a channel inner plate secured to the body and partially defining a channel axis, the channel inner plate comprising a central portion thereof and a pair of lateral extensions, each said lateral extension extending from the central portion a predetermined distance from the channel axis respectively;

a pair of channel outer plates secured to the body and positioned between the channel inner plate and the inner side of the mill shell, each said channel outer plate comprising respective outer portions positioned to engage the respective transverse portions, to resist movement of the respective transverse portions outwardly toward the inner side of the mill shell;

a channel central housing at least partially positioned between the channel inner plate and the channel outer plates, for locating the channel inner plate, the channel central housing comprising at least one outer arm and a cavity therein that is at least partially defined by said at least one outer arm;

a pair of insert elements respectively positioned between the outer portions of the channel outer plates and the inner surface of the mill shell to resist movement of the respective transverse portions outwardly;

at least one attachment assembly comprising:

a fixing washer at least partially positioned in the cavity and engaged with said at least one outer arm, said at least one outer arm being formed to resist movement of the fixing washer outwardly toward the inner side of the mill shell;

a bolt defining a bolt axis and extending between inner and outer ends, the bolt comprising a head at the inner end engageable with the fixing washer, the bolt being positionable in a predetermined position relative to the mill shell in which the bolt axis is substantially aligned with the channel axis, with the inner end engaged with the fixing washer and the outer end positioned outside the mill shell;

a nut threadably engageable with the bolt at the bolt's outer end;

an outer washer between the nut and the outer side of the mill shell, and engageable with the outer side of the mill shell when the nut is tightened, to subject the bolt to tension, to urge the head outwardly toward the inner side of the mill shell, securing the lifter bar inside the mill shell; and the channel outer plates and the inserts being configured to maintain the bolt in the predetermined position.

15. The liner system according to claim 14 additionally comprising:

a plurality of shell plates comprising first and second shell plates located with said at least one lifter bar therebetween;

each of said shell plates comprising a main portion and a toe portion; and each said toe portion being located between said at least one insert element and the inner side of the mill shell, to resist outward movement of said at least one insert element toward the inner side of the mill shell.

16. A lifter bar to be secured in a rotatable mill shell having an inner side and an opposed outer side, the lifter bar comprising:

a body thereof;

a channel plate secured to the body and defining a channel axis;

the channel plate comprising a central portion aligned with the channel axis and at least one lateral extension extending transversely from the central portion in relation to the channel axis;

the channel plate additionally comprising at least one outer arm and a cavity that is at least partially defined by said at least one outer arm; and at least one insert element positioned between said at least one lateral extension and the inner side of the mill shell, for resisting outward movement of said at least one lateral extension toward the inner side.

17. A method of maintaining a bolt securing a lifter bar in a rotatable mill shell having an inner side and an opposed outer side comprising:

(a) providing a channel plate secured to a body of the lifter bar, the channel plate having a central portion defining a channel axis and at least one lateral extension extending transversely from the central portion in relation to the channel axis; and (b) securing at least one insert element located between said at least one lateral extension and the inner side of the mill shell to said at least one lateral extension, for resisting movement of said at least one lateral extension toward the inner side of the mill shell.

* * * * *